US010116084B2

(12) United States Patent
Saitoh et al.

(10) Patent No.: US 10,116,084 B2
(45) Date of Patent: Oct. 30, 2018

(54) CONNECTOR

(71) Applicant: Yazaki Corporation, Tokyo (JP)

(72) Inventors: Masayuki Saitoh, Makinohara (JP); Dacheng Jin, Makinohara (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 14/843,046

(22) Filed: Sep. 2, 2015

(65) Prior Publication Data

US 2016/0064852 A1 Mar. 3, 2016

(30) Foreign Application Priority Data

Sep. 3, 2014 (JP) ..... 2014-179536

(51) Int. Cl.

| | |
|---|---|
| ***H01R 13/52*** | (2006.01) |
| ***H01R 4/18*** | (2006.01) |
| ***H01R 13/629*** | (2006.01) |
| ***H01R 13/631*** | (2006.01) |
| *H01R 13/422* | (2006.01) |
| *H01R 13/627* | (2006.01) |

(52) U.S. Cl.

CPC ..... *H01R 13/5202* (2013.01); *H01R 4/18* (2013.01); *H01R 13/629* (2013.01); *H01R 13/631* (2013.01); *H01R 4/184* (2013.01); *H01R 13/4223* (2013.01); *H01R 13/6271* (2013.01)

(58) Field of Classification Search

CPC ..... H01R 9/2491; H01R 11/12; H01R 11/11; H01R 13/648; H01R 13/502; H01R 13/4223; H01R 13/627; H01R 4/64

USPC ..... 439/350

See application file for complete search history.

(56) References Cited

U.S. PATENT DOCUMENTS 5,131,865 A * 7/1992 Taguchi ..... H01R 13/641 439/188
5,697,818 A * 12/1997 Fukuda ..... H01R 13/26 439/751
5,769,650 A * 6/1998 Aoyama ..... H01R 13/4365 439/189

(Continued)

FOREIGN PATENT DOCUMENTS

CN 1146081 A 3/1997
CN 1744387 A 3/2006

(Continued)

OTHER PUBLICATIONS

Notification of Reasons for Refusal dated Aug. 23, 2016, issued by the Japanese Patent Office in counterpart Japanese Application No. 2014-179536.

(Continued)

*Primary Examiner* — Abdullah Riyami
*Assistant Examiner* — Nader Alhawamdeh
(74) *Attorney, Agent, or Firm* — Sughrue Mion, PLLC

(57) ABSTRACT

A connector includes a housing that holds a plurality of terminals and a mating housing that holds a plurality of mating terminals to be connected to the terminals. The mating housing is fitted into the housing to connect the mating terminals to the terminals. The housing comprises a partition wall portion which projects ahead of the terminals and separates adjacent ones of the terminals from each other.

7 Claims, 4 Drawing Sheets

(56) References Cited

U.S. PATENT DOCUMENTS

| | | | | |
|---|---|---|---|---|
| 5,967,859 | A * | 10/1999 | Cecil, Jr. | H01R 13/4368 439/595 |
| 9,225,098 | B2 * | 12/2015 | Shinmi | H01R 13/422 |
| 2001/0000498 | A1 * | 4/2001 | Watanabe | H01R 12/774 439/66 |
| 2006/0105637 | A1 * | 5/2006 | Chiang | H01R 4/363 439/709 |
| 2007/0004288 | A1 | 1/2007 | Fukatsu et al. | |
| 2012/0094523 | A1 | 4/2012 | Hashimoto et al. | |
| 2013/0323958 | A1 | 12/2013 | Nakashima et al. | |
| 2014/0011389 | A1 * | 1/2014 | Shinmi | H01R 13/62 439/370 |
| 2014/0141640 | A1 * | 5/2014 | Nagashima | H01R 13/6272 439/350 |
| 2014/0213087 | A1 * | 7/2014 | Furuya | H01R 9/16 439/271 |
| 2014/0242824 | A1 * | 8/2014 | Karadimas | H01R 13/113 439/181 |
| 2014/0342602 | A1 * | 11/2014 | Shinmi | H01R 13/422 439/527 |
| 2016/0064852 | A1 * | 3/2016 | Saitoh | H01R 13/629 439/626 |
| 2016/0099522 | A1 * | 4/2016 | Suzuki | H01R 4/64 439/101 |

FOREIGN PATENT DOCUMENTS

| | | | |
|---|---|---|---|
| CN | 102544866 | A | 7/2012 |
| CN | 103748745 | A | 4/2014 |
| JP | 52040385 | U | 3/1977 |
| JP | 56-5827 | Y2 | 2/1981 |
| JP | 58-031680 | U1 | 8/1983 |
| JP | 2006066352 | A | 3/2006 |
| JP | 2007-12452 | A | 1/2007 |
| JP | 2013-247053 | A | 12/2013 |

OTHER PUBLICATIONS

Office Action dated Jan. 10, 2017 issued by the Japanese Patent Office in counterpart Japanese Patent Application No. 2014-179536.

Communication dated May 4, 2017, issued by the State Intellectual Property Office of P.R. China in counterpart Chinese application No. 201510555481.7.

Communication issued by the State Intellectual Property Office of P.R. China on Oct. 17, 2017 in counterpart 201510555481.7.

Communication dated Mar. 15, 2018, issued by The State Intellectual Property Office of the People's Republic of China in counterpart Chinese application No. 201510555481.7.

* cited by examiner

CONNECTOR

CROSS REFERENCE TO RELATED APPLICATIONS

This application is based on Japanese Patent Application (No. 2014-179536) filed on Sep. 3, 2014, the contents of which are incorporated herein by reference.

BACKGROUND

1. Field of the Disclosure

The present disclosure relates to a connector connecting a plurality of terminals with a plurality of mating terminals.

2. Description of the Related Art

In the related art, there has been known a connector including a female housing that holds a plurality of female terminals, and a male housing that holds a plurality of male terminals to be connected to the female terminals respectively, wherein the female housing and the male housing are fitted to each other so that the female terminals and the male terminals can be connected to each other respectively (for example, see JP-A-2013-247053).

A connector 50 disclosed in JP-A-2013-247053 is formed by fitting a female housing 53 and a male housing 56 to each other, as shown in FIG. 4. In the female housing 53, a plurality of cylindrical terminal reception chambers 52 are formed. Female terminals 51 are received in the terminal reception chambers 52 respectively. The male housing 56 holds male terminals 55 connected to a bus bar 54. The male terminals 55 are formed by insert molding. Each of the female housing 53 and the male housing 56 is formed of resin. The female terminals 51 inserted into the terminal reception chambers 52 are engaged with not-shown lances extended into the terminal reception chambers 52. Thus, the female terminals 51 are retained in predetermined positions of the terminal reception chambers 52 respectively. A hood portion 57 projecting like a rectangular cylinder from one end side of the terminal reception chambers 52 is provided in the female housing 53.

On the other hand, in the male housing 56, the male terminals 55 to be inserted and connected to the female terminals 51 are retained by insert molding. The male terminals 55 are connected to the bus bar 54. A body portion 59 is formed in a base portion 58 of the male housing 56 so as to be capped with the hood portion 57. A ring-like waterproof packing 60 is mounted between the body portion 59 and the hood portion 57. In the male housing 56, plate-like permanent lock arms 61 are formed to extend from the left and right side surfaces of the body portion 59 toward the outer circumferential surface of the hood portion 57. Lock grooves 62 are provided in the permanent lock arms 61 respectively. In the female housing 53, lock protrusions 63 are formed on the opposite side surfaces of the hood portion 57 correspondingly to the lock grooves 62. A pair of protruding walls 64 are provided on the top and bottom of each lock protrusion 63 so as to guide the permanent lock arms 61 inward respectively.

In the connector 50 configured thus, the female housing 53 and the male housing 56 are fitted to each other. When each permanent lock arm 61 is placed between the paired protruding walls 64 at the fitting time, the female housing 53 is made close to the male housing 56 while being guided along the lock groove 62 of the permanent lock arm 61. When the distal end portion of the permanent lock arm 61 gets over the lock protrusion 63, the lock protrusion 63 is engaged with the lock groove 62. The male terminals 55 are thus inserted and connected to the female terminals 51. In this state, the fitting of the two housings is completed.

In the male housing 53 disclosed in JP-A-2013-247053, the male terminals 55 are retained to protrude ahead of the base portion 58 of the male housing 56. Therefore, when the female housing 53 inclined to its regular fitting direction is made close to the male housing 56, the hood portion 57 is not guided by the permanent lock arms 61 but may touch the male terminals 55 to cause twisting (for example, damage such as deformation).

As for this point, a hood portion surrounding the male terminals 55 is provided in the body portion 59 of the male housing 56 so that the hood portion can extend ahead of the male terminals 55. When such a structure is used, the hood portion 57 of the female housing 53 can be prevented from touching the male terminals 55. However, when the hood portion of the male housing 56 is formed to be long in this manner, the total length of the connector 50 increases. Thus, there arises another problem that the connector 50 may increase in size.

SUMMARY

The present disclosure has been developed in consideration of the aforementioned problem. An object of the disclosure is to provide a miniaturized connector in which twisting can be prevented from being caused by abutment between each terminal of a housing and a mating housing when the two housings are fitted to each other.

In order to solve the foregoing problem, a connector according to the disclosure includes a housing that holds a plurality of terminals and a mating housing that holds a plurality of mating terminals to be connected to the terminals, wherein the mating housing is fitted into the housing to connect the mating terminals to the terminals, and wherein the housing includes a partition wall portion that projects ahead of the terminals and separates adjacent ones of the terminals from each other.

With this configuration, even when the mating housing inclined to its regular fitting direction is made close into the housing, the mating housing abuts against the partition wall portion so that the mating housing can be prevented from touching the terminals. Thus, twisting caused by the terminals can be prevented. In addition, when the partition wall portion projects ahead of the terminals inside the housing, the abutment between the mating housing and each terminal can be avoided regardless of the axial length of the housing. Thus, the axial length of the housing can be reduced so that the connector can be miniaturized.

For example, the partition wall portion includes partition walls, and in view from the mating housing, the terminals are arranged vertically and horizontally and the partition walls are disposed to cross one another.

With this configuration, the partition walls can be crossed and supported by one another. Thus, the partition walls can be enhanced in strength so that the partition walls can be suppressed from being deformed when the mating housing abuts against the partition walls.

For example, the partition wall portion extends to a position corresponding to an inner surface of the mating housing.

With this configuration, the mating housing can be guided along the partition wall portion so as to be introduced into the housing. Thus, the mating housing can be fitted so smoothly that the insertion force with which the mating housing is inserted into the housing can be reduced.

According to the disclosure, it is possible to provide a miniaturized connector in which twisting can be prevented from being caused by abutment between a mating housing and each terminal of a housing when the mating housing and the housing are fitted to each other.

For example, the mating housing is fitted into the housing through an opening of the housing, and the partition wall portion extends beyond leading ends of the terminals toward the opening of the housing.

For example, the partition walls include lateral partition walls and longitudinal partition walls which are perpendicular to each other.

DETAILED DESCRIPTION OF THE EXEMPLARY EMBODIMENTS

An embodiment in which a connector according to the disclosure is applied to a waterproof ground joint connector to be mounted on a vehicle will be described below with reference to the drawings. The waterproof ground joint connector is used when a plurality of electric wire terminals are connected in common to a ground conductor such as a vehicle body. However, the connector according to the disclosure is not limited to the waterproof ground joint connector but may be also applied to a normal connector for fitting a female connector and a male connector to each other, or a simple joint connector.

Figure 1:
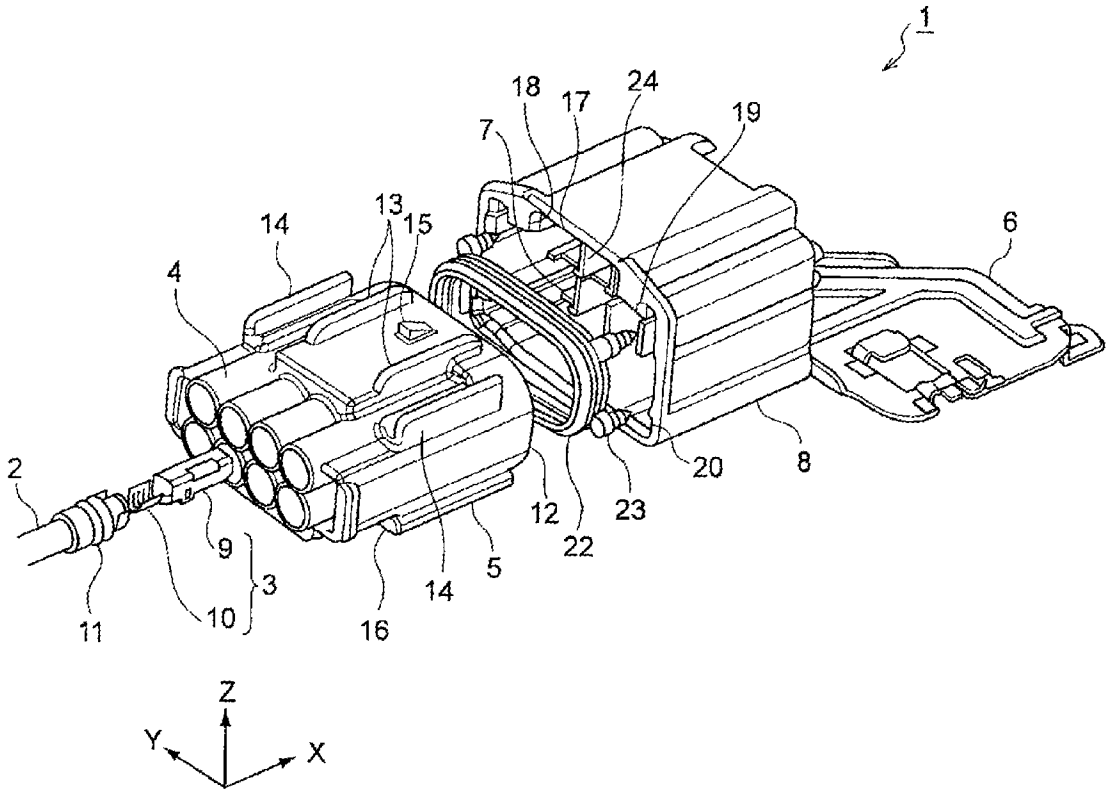
FIG. 1 is a perspective view showing a configuration of an embodiment of a connector according to the disclosure.

FIG. 1 shows the appearance configuration of a waterproof ground joint connector 1 according to the embodiment. The waterproof ground joint connector 1 has a female housing 5 and a male housing 8. Eight terminal reception chambers 4 are formed in the female housing 5. A female terminal 3 crimped on an electric wire 2 is received in each terminal reception chamber 4. The male housing 8 holds a plurality of male terminals 7 (male tubs) connected to a bus bar 6. The male terminals 7 are formed by insert molding. Each of the female housing 5 and the male housing 8 is formed out of resin. Incidentally, in FIG. 1, the arrow X designates a front/rear direction, the arrow Y designates a left/right direction, and the arrow Z designates an up/down direction.

Each female terminal 3 is formed to have a contact portion 9 and a crimp terminal portion 10. The contact portion 9 is formed into a rectangular cylinder including an elastically deformable contact member (not shown). The crimp terminal portion 10 is to be crimped on a conductor part (not shown) exposed from the electric wire 2. A waterproof plug 11 is mounted on a coated outer circumferential surface of the electric wire 2. Each terminal reception chamber 4 of the female housing 5 is formed into a cylinder as a whole. A not-shown lance is formed in the terminal reception chamber 4 so as to extend toward the internal space of the female housing 5. When the elastically deformed lance is engaged with the contact portion 9 of the female terminal 3 inserted into the terminal reception chamber 4, the female terminal 3 can be prevented from coming out.

The female housing 5 is formed into a rectangular parallelepiped as a whole, in which the eight terminal reception chambers 4 are arranged vertically and horizontally. A hood portion 12 covering the outer circumferential surfaces of the terminal reception chambers 4 is formed to project toward the male housing 8. On the top of the hood portion 12, a pair of first protruding walls 13, a pair of second protruding walls 14 and a lock protrusion 15 are provided. The first protruding walls 13 extend in the fitting direction of the female housing 5. The second protruding walls 14 are located outside the first protruding walls 13 respectively. The lock protrusion 15 is located inside the paired first protruding walls 13. Third protruding walls 16 are provided in side portions of the hood portion 12 respectively.

The eight male terminals 7 to be inserted and connected to the female terminals 3 are retained in the male housing 8 by inset molding. Each male terminal 7 is, for example, formed as follows. That is, a plate-like conductor is folded into a U-shape, and the both ends of the U-shape are inserted into two female terminals 3 of the female housing 5 so that the ends can be connected to the contact members of the female terminals 3 slidably thereon respectively. In addition, each male terminal 7 is connected to the bus bar 6 and connected to a ground conductor of the vehicle body through the bus bar 6 so as to form a grounding circuit.

A recess portion 17 is formed in the male housing 8 so as to be open toward the female housing 5. The recess portion 17 is formed into a sectional shape corresponding to the outer circumferential surface of the hood portion 12 of the female housing 5, so that the female housing 5 can be fitted into the recess portion 17. First fitting grooves 18, second fitting grooves 19 and third fitting grooves 20 to which the first protruding walls 13, the second protruding walls 14 and the third protruding walls 15 can be fitted respectively are provided in the inner wall of the recess portion 17. In addition, an opening (not shown) is provided in the male housing 8 so that the lock protrusion 15 can be engaged with the opening when the hood portion 12 is fitted to the recess portion 17. When the lock protrusion 15 is engaged with the opening, the hood 12 can be retained in the recess portion 17.

Figure 2:
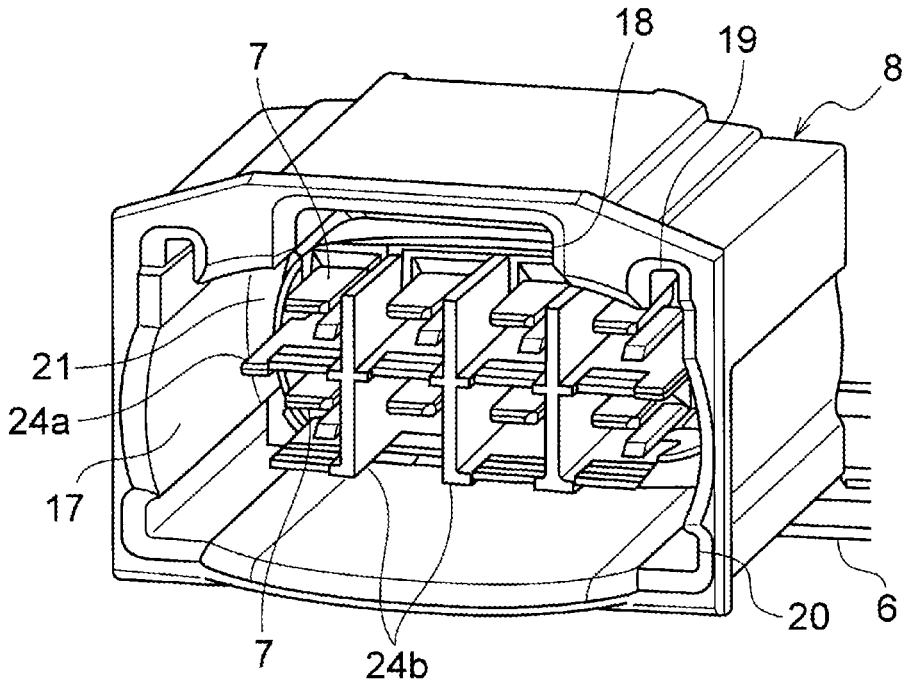
FIG. 2 is an enlarged perspective view in which a male housing in FIG. 1 is observed from the side of a female housing.

As shown in FIG. 2, the male terminals 7 are arranged vertically and horizontally in the recess portion 17 in view from the female housing 5. An annular waterproof packing 22 can be mounted between a wall portion 21 (bottom wall of the female housing 5) opposed to the opening of the recess portion 17 and the hood portion 12 fitted to the recess portion 17, as shown in FIG. 1. In the waterproof packing 22, a plurality of columnar protruding portions 23 are provided to extend in the axial direction of the packing. When the protruding portions 23 are inserted into not-shown holes formed in the wall portion 21, the waterproof packing 22 can be retained in the male housing 8.

Here, partition walls of the male terminal 7 will be described. As shown in FIG. 2, plate-like partition walls 24 are provided between adjacent ones of the male terminals 7 in the male housing 8 according to the embodiment. The partition walls 24 are formed to extend from the wall portion 21 in the axial direction of the male housing 8 (a fitting direction of the male housing 8 and the female housing 5) and project ahead of the male terminals 7, that is, toward the female housing 5. The partition walls 24 are provided to separate adjacent ones of the male terminals 7 from each other.

The partition walls 24 include lateral partition walls 24*a* and longitudinal partition walls 24*b*. The lateral partition walls 24*a* extend in the left/right direction to separate the male terminals 7 adjacent to each other in the up/down direction. The longitudinal partition walls 24*a* extend in the up/down direction to separate the male terminals 7 adjacent to each other in the left/right direction. The lateral partition walls 24*a* and the longitudinal partition walls 24*b* cross each other substantially perpendicularly to be formed into a lattice and provided separately from the male terminals 7 respectively. The distal end surfaces of the lateral partition walls 24*a* are positioned behind the distal end surfaces of the longitudinal partition walls 24*b* so as to be flush with one another. Incidentally, in the embodiment, the distal end surfaces of the partition walls 24 are located behind the opening of the recess portion 17. However, the distal end surfaces may be provided to project ahead of the opening.

In addition, in each partition wall 24, a side end surface extending in the axial direction of the male housing 8 is provided to extend to a position corresponding to the inner surface of the hood portion 12 to be fitted to the recess portion 17, so that the hood portion 12 inserted into the recess portion 17 can be guided and fitted between the inner side wall of the recess portion 17 and the side end surface of the partition wall 24.

Next, description will be made about operation during assembling of the waterproof joint connector 1 configured thus. First, the female housing 5 and the male housing 8 are made close to each other relatively, so that the first to third protruding walls 13 to 15 of the hood portion 12 can be aligned with the first to third fitting grooves 18 to 20 of the recess portion 17. In this state, for example, the hood portion 12 is pushed into the recess portion 17. Thus, the first to third protruding walls 13 to 15 move along the first to third fitting grooves 18 to 20 respectively so that the hood portion 12 can be inserted into the recess portion 17.

Next, the hood portion 12 pushed into the recess portion 17 is guided to a gap between the inner side wall of the recess portion 17 and the side end surface of each partition wall 24 so that the hood portion 12 can move along the gap inside the recess portion 17. The lock protrusion 15 moves pressing the inner wall surface of the recess portion 17. The lock protrusion 15 is engaged with the opening of the recess portion 17. As a result, the lock protrusion 15 is locked in the opening of the recess portion 17 so that the hood portion 12 can be prevented from coming off. Thus, the fitting is completed. In the state where the fitting is completed, the male terminals 7 are inserted and connected to the contact portions 9 of the female terminals 3, and the hood portion 12 is retained within the recess portion 17 while pressing the waterproof packing 22.

Figure 3:
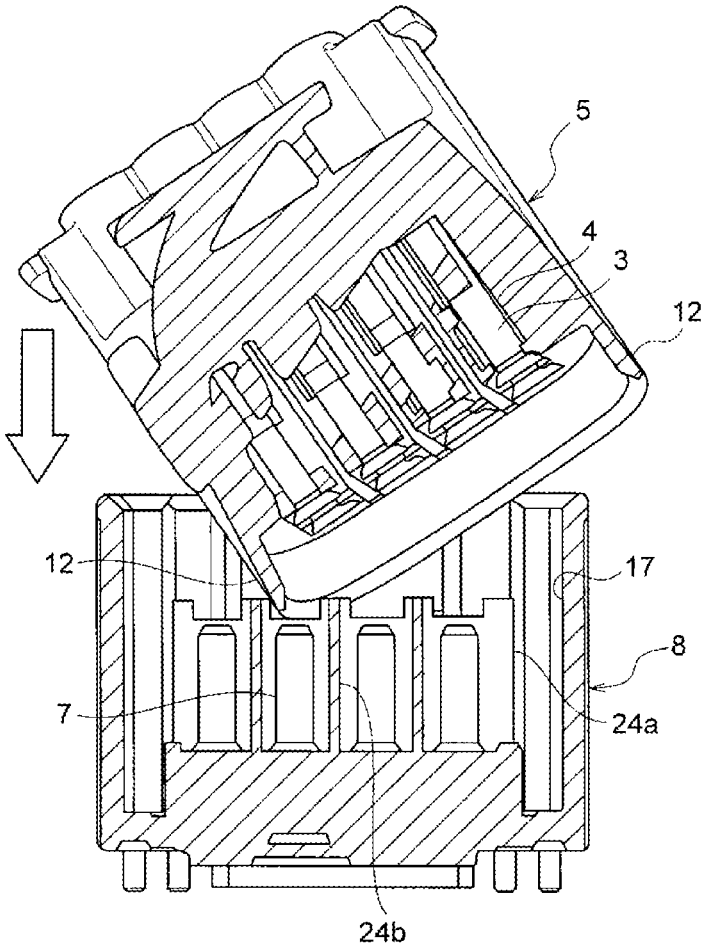
FIG. 3 is an operation view in which the inclined female housing is inserted into the male housing.
Figure 4:
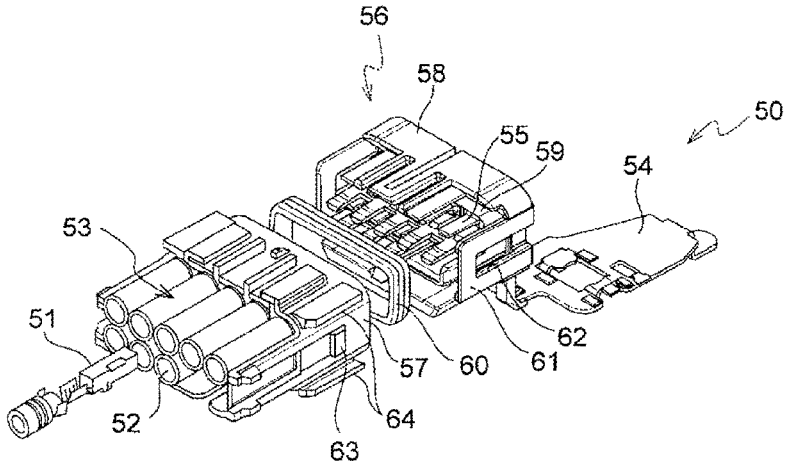
FIG. 4 is a perspective view showing a configuration of an embodiment of a connector according to the related art.

The hood portion 12 can be inserted into the recess portion 17 in its regular fitting posture as long as the first to third protruding walls 13 to 15 are inserted along the first to third fitting grooves 18 to 20 of the recess portion 17 respectively. However, as shown in FIG. 3, it is considered that the hood portion 12 may be inserted into the recess portion 17 obliquely to the regular fitting posture when the hood portion 12 is made close to the recess portion 17 in the state where the first to third protruding walls 13 to 15 are not inserted into the first to third fitting grooves 18 to 20 respectively.

With respect to this point, in the embodiment, the partition walls 24 are formed to project ahead of the male terminals 7 inside the recess portion 17, so that the hood portion 12 can abut against the partition walls 24 even when the hood portion 12 is inserted into the recess portion 17 obliquely to the regular fitting posture. Thus, the male terminals 7 can be prevented from touching the hood portion 12, so that twisting caused by the male terminals 7 (for example, damage such as deformation on the hood portion 12) can be prevented.

In addition, in the state where the female housing 5 and the male housing 8 have been fitted to each other, the contact portions 9 of the female terminals 3 are inserted to gaps between the male terminals 7 and the partition walls 24 so as to surround the male terminals 7, respectively. At least the distal end surfaces of the partition walls 24 are not in contact with the female housing 5 side. That is, the partition walls 24 do not restrict the fitting state (fitting position) of the two housings at all. Therefore, for example, when the axial length of the hood portion 12 of the female housing 5 is set to be short, the waterproof ground joint connector 1 can be miniaturized.

In addition, in the embodiment, the lateral partition walls 24*a* and the longitudinal partition walls 24*b* are disposed to cross each other substantially perpendicularly, so that the strength of the partition walls 24 can be enhanced. Thus, even when the hood portion 12 touches any one of the partition walls 24, the partition wall 24 can be suppressed from being damaged. Abutment between each male terminal 7 and the hood portion 12 can be prevented so surely that twisting caused by the male terminal 7 can be prevented. Incidentally, the lateral partition walls 24*a* and the longitudinal partition walls 24*b* do not have to cross each other perpendicularly but it will go well if they are formed to cross each other.

In addition, in the embodiment, the lateral partition walls 24*a* and the longitudinal partition walls 24*b* are provided to extend to positions corresponding to the inner surface of the hood portion 12, so that the hood portion 12 inserted into the recess portion 17 can be guided and fitted to a gap between the inner side wall of the recess portion 17 and the side end surface of each partition wall 24. Thus, the hood portion 12 can be fitted smoothly along the side end surface of each partition wall 24 without strongly touching the partition wall 24. It is therefore possible to reduce the insertion force of the hood portion 12, so that the workability in assembling can be improved.

Although the embodiment of the disclosure has been described in detail with reference to the drawings, the aforementioned embodiment illustrates the disclosure merely by way of example. The embodiment may be changed or modified within the scope stated in claims.

An example in which the partition walls 24 for separating the male terminals 7 from one another are provided in the male housing so that the female housing can be fitted into the male housing has been described in the embodiment. However, for example, partition walls 24 for separating the female terminals 3 from one another may be instead provided in the female housing so that the male housing can be fitted into the female housing. In this manner, the distal end portion of the male housing can be prevented from touching the female terminals, so that twisting caused by the female terminals can be prevented.

In addition, an example in which the first to third protruding walls 13 to 15 of the hood portion 12 are inserted along the first to third fitting grooves 18 to 20 of the recess portion 17 respectively has been described in the embodiment. However, the recess portion 17 can be guided along the inner wall surface of the hood portion 12. In addition, the recess portion 17 can be also guided along the side end surfaces of the partition walls 24 on the way of the insertion.

Therefore, the first to third fitting grooves 18 to 20 and the first to third protruding walls 13 to 15 may be removed.

In addition, an example in which the partition walls 24 are provided in all the gaps between the male terminals 7 adjacent to each other respectively has been described in the embodiment. However, the partition walls 24 in a part of the gaps between the male terminals 7 adjacent to each other may be removed as long as the distal end portion of the hood portion 12 does not touch any male terminal 7 even if the hood portion 12 is inserted at any angle. In this case, it is preferable that each male terminal 7 is partitioned by four partition walls 24 on its four sides. However, it will go well if each male terminal 7 is partitioned by at least two opposed partition walls 24.

What is claimed is:

1. A connector comprising:

a housing that holds a plurality of terminals; and a mating housing that holds a plurality of mating terminals to be connected to the terminals, wherein the mating housing is fitted inside of the housing to connect the mating terminals to the terminals;

wherein the housing comprises a partition wall portion including partition walls which project ahead of the terminals and separate adjacent ones of the terminals from each other, wherein the partition walls include lateral partition walls and longitudinal partition walls which are perpendicular to each other, and wherein distal end surfaces of the lateral partition walls are positioned behind distal end surfaces of the longitudinal partition walls.

2. The connector according to claim 1, wherein in view from the mating housing, the terminals are arranged vertically and horizontally and the partition walls are disposed to cross one another.

3. The connector according to claim 1, wherein the partition wall portion extends to a position corresponding to an inner surface of the mating housing.

4. The connector according to claim 1, wherein the mating housing is fitted inside of the housing through an opening of the housing; and wherein the partition wall portion extends beyond leading ends of the terminals toward the opening of the housing.

5. The connector according to claim 1, wherein the housing has a recess portion defined by an inner wall opened toward the mating housing;

wherein the mating housing has a hood portion that projects toward the housing; and wherein the mating housing is fitted into the housing, the hood portion is inserted into the recess portion.

6. A connector comprising:

a housing that holds a plurality of terminals; and a mating housing that holds a plurality of mating terminals to be connected to the terminals, wherein the mating housing is fitted inside of the housing to connect the mating terminals to the terminals; and wherein the housing comprises a partition wall portion which projects ahead of the terminals and separates adjacent ones of the terminals from each other and wherein distal end surfaces of the partition wall portion are not in contact with the mating housing when the mating housing is fitted inside of the housing.

7. The connector according to claim 1 further comprising:

an annular waterproof packing disposed in the housing.

* * * * *